US005383009A

United States Patent [19]

Tsusaka

[11] Patent Number: 5,383,009

[45] Date of Patent: Jan. 17, 1995

[54] DEVELOPING DEVICE OF ELECTROSTATIC APPARATUS HAVING SEPARATE SEALED INITIAL DEVELOPER AND MAGNETIC TONER STORAGE SPACES

[75] Inventor: Shusaku Tsusaka, Nagoya, Japan

[73] Assignee: Brother Kogyo Kabushiki Kaisha, Nagoya, Japan

[21] Appl. No.: 59,296

[22] Filed: May 11, 1993

[30] Foreign Application Priority Data

Aug. 31, 1992 [JP] Japan ..... 4-230843

[51] Int. Cl.[6] ..... G03G 15/06

[52] U.S. Cl. ..... 355/260; 118/657; 355/245; 355/251; 355/253

[58] Field of Search ..... 355/260, 215, 246, 210, 355/200, 326, 245, 251, 252, 250, 253, 256, 259; 118/656–658; 222/DIG. 1, 544, 548

[56] References Cited

U.S. PATENT DOCUMENTS

| | | | |
|---|---|---|---|
| 4,351,604 | 9/1982 | Karasawa et al. | 355/326 X |
| 4,606,990 | 8/1986 | Yoshikawa | 118/658 X |
| 4,607,938 | 8/1986 | Hosoi et al. . | |
| 4,615,608 | 10/1986 | Mizutani . | |
| 4,676,192 | 6/1987 | Yuge et al. . | |
| 4,838,200 | 6/1989 | Hosoi et al. | 118/658 |
| 4,876,574 | 10/1989 | Tajima et al. | 355/253 |
| 4,916,492 | 4/1990 | Hoshika et al. | 355/253 |
| 4,998,140 | 3/1991 | Satou et al. | 355/245 |
| 5,027,156 | 6/1991 | Kobayashi | 355/245 |
| 5,028,961 | 7/1991 | DeCecca | 355/260 |
| 5,249,020 | 9/1993 | Takano | 355/260 |

FOREIGN PATENT DOCUMENTS

| | | |
|---|---|---|
| 60-101566 | 6/1985 | Japan . |
| 61-53677 | 3/1986 | Japan . |
| 63-4282 | 1/1988 | Japan . |

*Primary Examiner*—A. T. Grimley
*Assistant Examiner*—Shuk Y. Lee
*Attorney, Agent, or Firm*—Oliff & Berridge

[57] ABSTRACT

A developing device containing an initial developer in a sealed initial developer storage space sealed with a film and a magnetic toner in a sealed toner container is mounted on the frame of an electrostatic apparatus. Then, the film sealing the initial developer storage space and the toner container is removed to let the initial developer fall into an initial developer containing space near a developing sleeve and to let the magnetic toner fall into a space separated from the initial developer containing space by a partition wall. As the magnetic toner of the initial developer is consumed with the progress of printing operation, the toner flows through a gap defined by the partition wall into the initial developer containing space. The initial developer and the magnetic toner can be surely supplied to the developing sleeve simply by removing the film before using the developing device.

24 Claims, 6 Drawing Sheets

DEVELOPING DEVICE OF ELECTROSTATIC APPARATUS HAVING SEPARATE SEALED INITIAL DEVELOPER AND MAGNETIC TONER STORAGE SPACES

BACKGROUND OF THE INVENTION

1. Field of the Invention

The present invention relates to a developing device of an electrostatic developing device and, more particularly, to a developing device of an electrostatic apparatus such as an electrostatic copying machine or a laser printer.

2. Description of Related Art

A prior art electrostatic apparatus employs a pseudo two-component developing system using a developer consisting of a magnetic toner and a magnetic carrier. A process cartridge 51 for the pseudo two-component developing system will be described with reference to FIG. 7.

The process cartridge 51 comprises a photoconductive drum 52, a charger 54, a cleaning blade 58 and a developing unit 63 comprising a developing sleeve 56 internally provided with a magnet roller 60, a developer container 64 containing a developer 66, and a doctor blade 62 disposed above the developing sleeve 56. The charger 54, the developing sleeve 56 and the cleaning blade 58 are arranged in that order around the photoconductive drum 52 along the direction of rotation of the photoconductive drum 52 indicated by the arrow z. The developer 66 is, for example, a mixture of a magnetic toner and a magnetic carrier, having a magnetic toner content of about 40% by weight and a magnetic carrier content of about 60% by weight.

In the process cartridge 51 thus constructed, the developing sleeve 56 is rotated in the direction of the arrow x, and the magnet roller 60 is rotated in the direction of the arrow y. Then, the developer 66 adheres to the circumference of the developing sleeve 56, the doctor blade 62 regulates the amount of the developer 66 on the circumference of the developing sleeve 56 so that a layer of the developer 66 of a predetermined thickness is formed over the circumference of the developing sleeve 56. The layer of the developer 66 of the predetermined thickness is carried to a developing point 50 between the photoconductive drum 52 and the developing sleeve 56 by the rotating developing sleeve 56.

Since the developing sleeve 56 and the magnet roller 60 rotate respectively in opposite directions, the S-poles and the N-poles of the magnet roller 60 move at a considerably high speed relative to the developer 66 coating the circumference of the developing sleeve 56. Hence, the polarity of the magnetic field applied to the developer 66 changes rapidly. Consequently, as shown in FIG. 8, brushes 66A of the developer 66 roll on the circumference of the developing sleeve 56 as the same are carried toward the developing point 50.

At the developing point 50, only the magnetic toner is transferred to the photoconductive drum 52 according to an image formed on the photoconductive drum 52. The magnetic carrier remains on the circumference of the developing sleeve 56. The magnetic carrier remaining on the circumference of the developing sleeve 56 is returned to the developer container 64. Thus, the developer 66 is charged as it passes the gap between the developing sleeve 56 and the doctor blade 62 and rolls on the circumference of the developing sleeve 56.

When developing an image by the pseudo two-component developing system, the quality of the developed image is dependent on the ratio between the magnetic toner content and the magnetic carrier content of the developer 66 coating the circumference of the developing sleeve 56; the greater the percentage of the magnetic carrier content, the higher is the quality of the developed image. However, since the developing unit 63 shown in FIG. 7 contains the developer 66 (i.e., a mixture of the magnetic toner and the magnetic carrier) dispersed in the developer container 64, it is impossible to maintain a high percentage of the magnetic carrier in the vicinity of the developing sleeve 56.

A developing unit employing a pseudo two-component developing system using a magnetic toner and a magnetic carrier intended to overcome such a disadvantage is disclosed in U.S. Pat. No. 4,676,192, shown in FIG. 9. As shown in FIG. 9, in this developing unit 120, a magnetic toner container 125 and a magnetic carrier container 126 are disposed contiguously and separated from each other by a partition wall 124. A developing sleeve 56 is disposed with a gap between its circumference and the edge of the partition wall 124. The upper opening of the magnetic toner container 125 is closed by a cover 129, and the upper opening of the magnetic carrier container 126 is closed by a cover 127. When replenishing the magnetic toner container 125 and the magnetic carrier container 126 respectively with a magnetic toner and a magnetic carrier, the covers 129 and 127 are opened.

The magnetic toner is supplied to the developing sleeve 56 in a magnetic toner supply region 128, and the magnetic carrier is supplied from the magnetic carrier container 126 to the developing sleeve 56. Developer brushes are formed on the circumference of the developing sleeve 56. The height of the developer brushes is regulated by a doctor blade 62, and the developer brushes of a predetermined height are carried to a developing point 50.

The partition wall 124 prevents the magnetic carrier from flowing into the magnetic toner container 125. Hence, the magnetic carrier will not be dispersed in the magnetic toner in the magnetic toner container 125. Thus, the percentage of the magnetic carrier in the developer coating the circumference of the developing sleeve 56 can be maintained at a substantially constant high percentage, and an image formed on a photoconductive drum 52 can be developed with the developer having a high magnetic carrier percentage in a developed image of a high quality.

When using the developing unit 120 for the first time, the new developing unit 120 is set in place, the cover 127 is opened, and the magnetic carrier is supplied into the magnetic carrier container 126 in a first step. In a second step, cover 129 is opened, and the magnetic toner is supplied into the magnetic toner container 125. Thus, the developing unit 120 requires two steps to supply developer before using the unit for the first time, which is troublesome. Furthermore, there is the possibility that the operator will forget to carry out either the first step of supplying the magnetic carrier or the second step of supplying the magnetic toner. If the operator forgets to carry out the first step, an image is developed only with the magnetic toner. Consequently, the image cannot be developed in a developed image of satisfactory quality.

Such problems may be prevented by packing only the magnetic carrier in the magnetic carrier container 126 before shipping the developing unit. However, since the magnetic carrier cannot be sealed in the magnetic carrier container 126, the magnetic carrier spills out from the magnetic carrier container during transportation.

SUMMARY OF THE INVENTION

Accordingly, it is an object of the present invention to provide an electrostatic developing device which ensures the supply of a developer to the developing sleeve thereof before starting developing operation and enables the developer to be surely and simply supplied to the developing sleeve.

In order to achieve the above and other objects, the electrostatic developing device of the present invention comprises: first storing means for storing first magnetic developer; second storing means for storing second magnetic developer; rotatable developer carrying means for carrying the first magnetic developer and the second magnetic developer; rotatable magnetic means provided within said rotatable developer carrying means for charging the first magnetic developer and the second magnetic developer; a blade for restraining a thickness of the first magnetic developer and the second magnetic developer carried on said developer carrying means; a separating wall for separating said first storing means and said second storing means, said separation wall separates said first storing means and said second storing means in an upper part and in a lower part respectively; and sealing means for sealing at least said second storing means, wherein if said sealing means is released the second magnetic developer is supplied to the adjacent of said developer carrying means and a supplying path is formed throughout said first storing means and said second storing means.

In operation of the electrostatic apparatus of the present invention, the first storing means stores the first developer, the second storing means stores the second developer, the rotatable developer carrying means carries the first magnetic developer and the second magnetic developer, the rotatable magnetic means provided within the rotatable developer carrying means charges the first magnetic developer and the second magnetic developer, a blade restrains a thickness of the first magnetic developer and the second magnetic developer carried on the developer carrying means, the separating wall separates the first storing means and the second storing means in an upper part and in a lower part respectively, the sealing means seals at least the second storing means and, if the sealing means is released the second magnetic developer is supplied to the adjacent of the developer carrying means and a supplying path is formed throughout the first storing means and the second storing means.

According to the present invention, the second developer will never spill out from the second developer container during transportation because the second developer is sealed in the second developer container with the film, and the first developer and the second developer can be surely supplied respectively to predetermined positions in the cartridge simply by removing the film.

BRIEF DESCRIPTION OF THE DRAWINGS

The above and other objects, features and advantages of the present invention will become more apparent from the following description taken in connection with the accompanying drawings, in which.

DETAILED DESCRIPTION OF PREFERRED EMBODIMENTS

Figure 1:
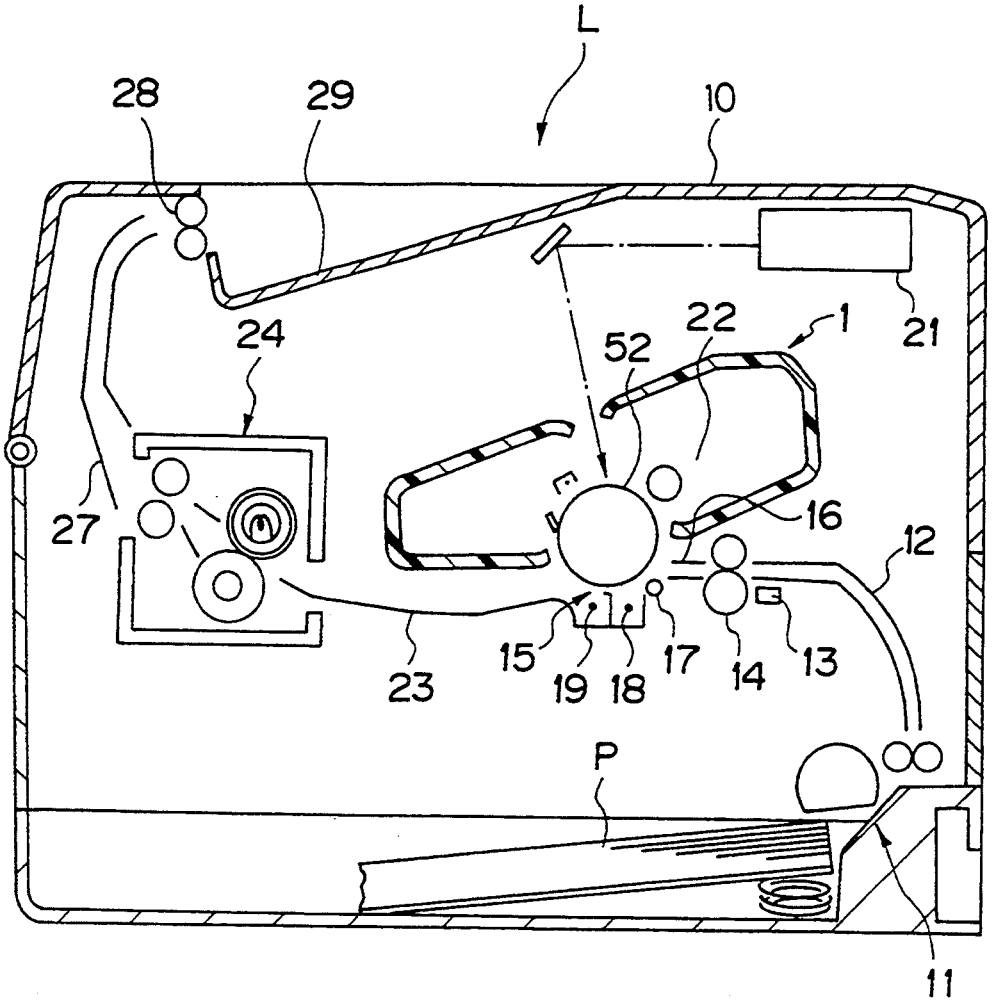
FIG. 1 is a schematic sectional view of a laser printer that uses a developing device in accordance with the present invention.

Referring to FIG. 1, a laser printer L has a body 10, and a sheet feed unit 11 is disposed in the lower portion of the body 10 to feed recording sheets P one at a time to an image forming unit 15. The recording sheet P sent out by the sheet feed unit 11 advances along a guide passage provided by guide plates 12 to a pair of register rollers 14. A sheet sensor 13 is disposed before the register rollers 14. The register rollers 14 start rotating at an interval of specified time after a detection signal has been provided by the sheet sensor 13 upon the detection of the recording sheet P. The recording sheet P is registered and advanced by the register rollers 14 into a sheet feed passage provided by a pair of opposite guide plates 16. A photoconductive drum 52 and a transfer roller 17 are disposed opposite to each other behind the guide plates 16. The transfer roller 17 guides the recording sheet P so as to bring the recording sheet P into close contact with the circumference of the photoconductive drum 52. The recording sheet P advances toward the image forming unit 15 as the photoconductive drum 52 rotates.

The image forming unit 15 comprises a scanning device 21, a developing device 1 of the present invention for developing an electrostatic latent image formed on the circumference of the photoconductive drum 52, a transfer charger 18 for transferring a toner image formed by developing the electrostatic latent image to the recording sheet P, and a static eliminator 19 for eliminating static electricity from the recording sheet P to facilitate separating the recording sheet P from the photoconductive drum 52. After a toner image has been formed on the recording sheet P by the image forming unit 15, the recording sheet P is transferred along a guide plate 23 to a fixing unit 24. After the toner image has been fixed to the recording sheet P by the fixing unit 24, the recording sheet P is advanced upward along a sheet passage provided by guide plates 27 and delivered onto a delivery tray 29 by a pair of delivery rollers 28.

The developing device 1 included in a process cartridge C will be described hereinafter with reference to FIG. 2. The developing device 1 consists of an upper unit 1A and a lower unit 1C. A partition wall 2 is disposed on the right-hand side of a doctor blade 62 as viewed in FIG. 2. The partition wall 2 has a base section 2C and an upward convex swing section 2B pivotally joined to the base section 2C with a shaft 2A. A film 3 is extended between the base section 2C and a projection 1B formed in the upper unit 1A to seal a toner container 64. The film 3 can be easily extended from the base section 2C via the free end of the swing section 2B to the projection 1B because the swing section 2B and projection 1B are in contact each other.

An initial developer containing space 65 is formed by the partition wall 2 and the film 3, and the initial developer containing space 65 is filled up with an initial developer 5 consisting of, for example, 6 parts by weight of magnetic carrier and 4 parts by weight of magnetic toner. A pure magnetic toner 20 is contained in a space over the partition wall 2. This developing device 1 is of a pseudo two-component developing system using a magnetic toner and a magnetic carrier. Since the initial developer 5 and the magnetic toner 20 are separated and sealed in the upper unit 1A by the partition wall 2 and the film 3 when the process cartridge C is sent out from the manufacturer, the initial developer 5 and the magnetic toner 20 will not spill out during transportation.

When using the process cartridge C, the film 3 is pulled longitudinally through a slit in the cartridge to remove the film 3 from the process cartridge C. The slit is preferably formed in a wall of the lower unit, or the film may extend outwardly between the upper and lower units. In the case of the slit, the opening is very small to prevent toner from leaking from the cartridge. Also, a seal may be formed around the opening to prevent toner from leaking through the slit while the film is being removed.

Figure 3:
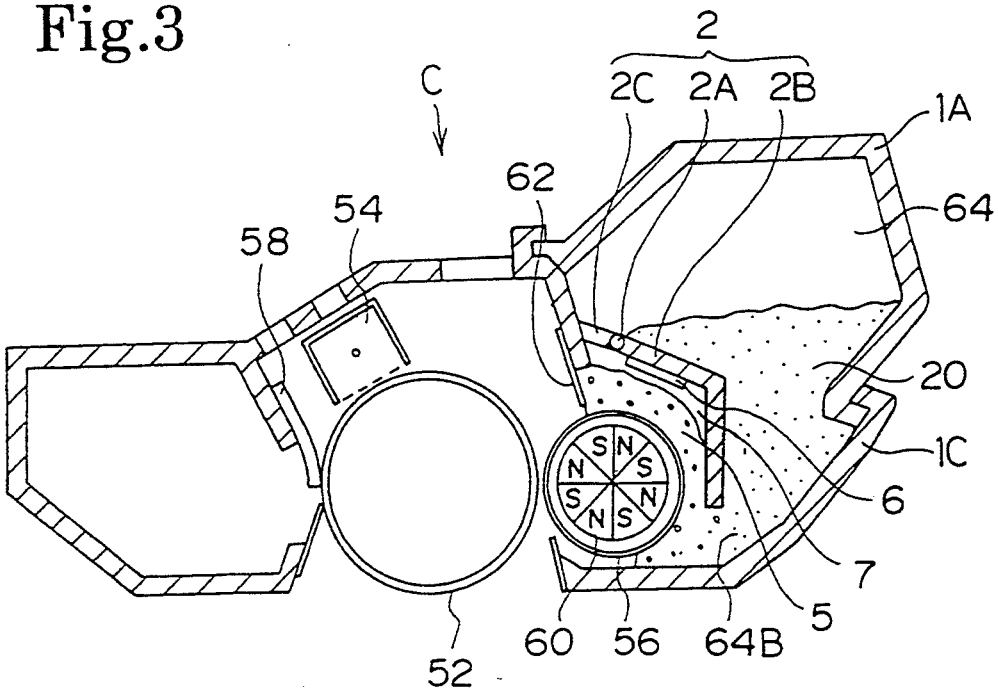
FIG. 3 is a schematic sectional view of the process cartridge of FIG. 2 in a state where a sealing film has been removed.

After the film 3 is removed, the initial developer 5 falls over a developing sleeve 56, and the component magnetic toner and magnetic carrier of the initial developer 5 are attracted to the circumference of the developing sleeve 56 by the magnetic force of a magnet roller 60 received in the developing sleeve 56. Meanwhile, the swing section 2B of the partition wall 2 is turned clockwise as viewed in FIG. 3 on the shaft 2A by the weight of the magnetic toner 20 and stopped by a stopper 6 projecting from the side wall of the process cartridge C. In this state, an initial developer storage space 7 large enough to accommodate the initial developer 5 is formed between the developing sleeve 56 and the partition wall 2 and a supplying path 64b is formed between the swing section 2B and the bottom wall of the lower unit 1B. The magnetic toner 20 stored in the space over the partition wall 2 falls into a space extending on the right-hand side of the partition wall 2 and flows through the supplying path 64B toward the developing sleeve 56. As shown in FIG. 3, a narrow space is formed between the free edge of the swing section 2B and the developing sleeve 56. Thus, it is difficult for the magnetic toner to flow from the toner container 64 into the initial developer storage space 7.

Figure 2:
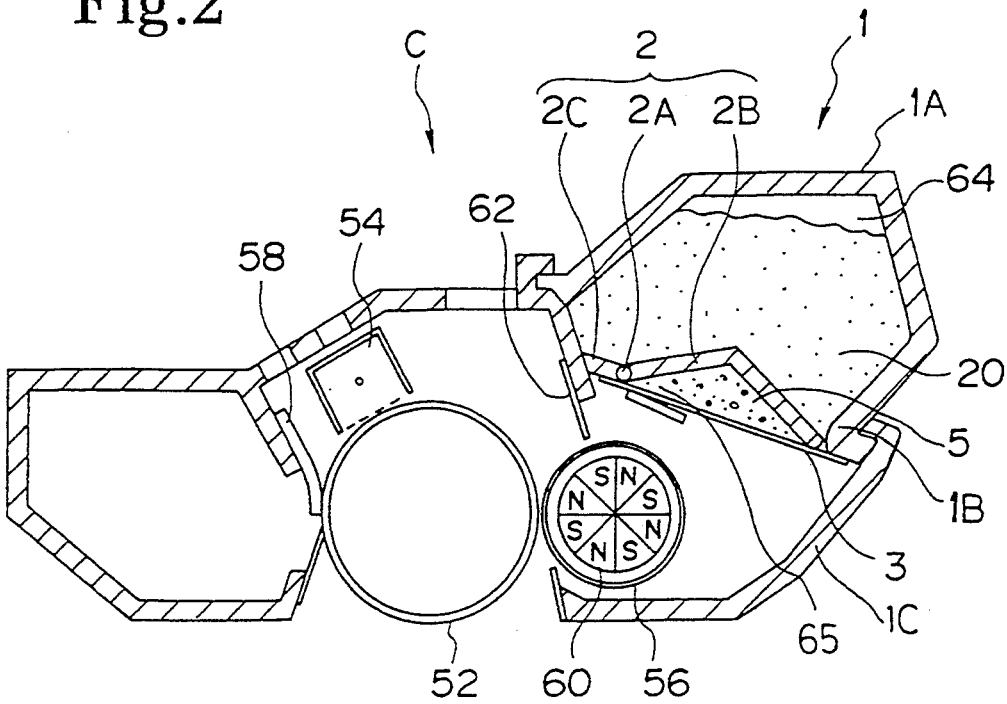
FIG. 2 is a schematic sectional view of an unused process cartridge including a developing device in a first embodiment according to the present invention.

The process cartridge C is mounted on a reserve tank L (FIG. 1) in a state shown in FIG. 2, and then the film 3 is removed from the process cartridge C. Then, the initial developer 5 and the magnetic toner 20 start falling in the space near the developing sleeve 56. Upon the connection of the laser printer to the power source, the developing sleeve 56 and the magnet roller 60 are rotated respectively in specified directions, and the initial developer 5 adheres over the entire circumference of the developing sleeve 56 to complete the preparation for printing operation.

Since the magnetic toner 20 is separated from the initial developer 5 by the partition wall 2, the magnetic carrier does not disperse through the supplying path 64B into the magnetic toner 20 during printing operation. Since the magnetic toner 20 is supplied continuously through the supplying path 64B to the developing sleeve 56, the magnetic carrier percentage of the developer adhering to the circumference of the developing sleeve 56 can be maintained at a high value.

Since the initial developer 5 and the magnetic toner 20 are sealed in the upper unit 1A, the initial developer 5 and the magnetic toner 20 will not spill out during the transportation of the process cartridge C. Since the initial developer 5 and the magnetic toner 20 can be supplied into the predetermined spaces simply be removing the film 3 from the process cartridge C, the process cartridge C can be easily set for operation and both the initial developer 5 and the magnetic toner 20 can be supplied without fail.

Figure 6:
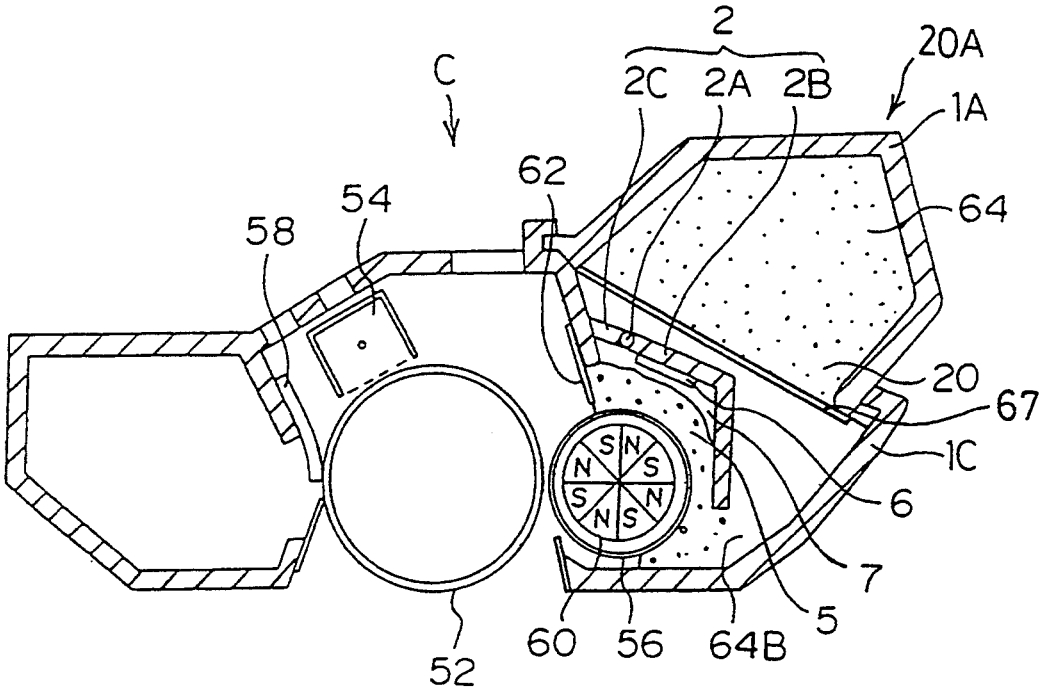
FIG. 6 is a schematic sectional view of the process cartridge of FIG. 2 in a state prepared for replenishing the process cartridge with a magnetic toner.
Figure 7:
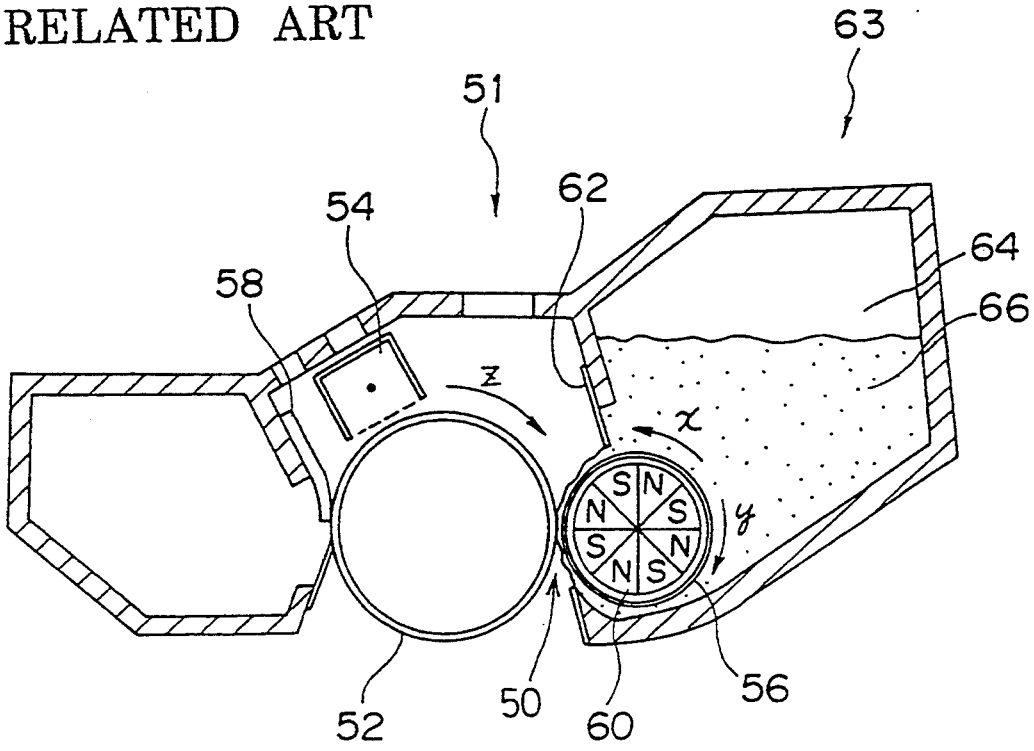
Fig.7 RELATED ART
FIG. 7 is a schematic sectional view of a prior art process cartridge.
Figure 8:
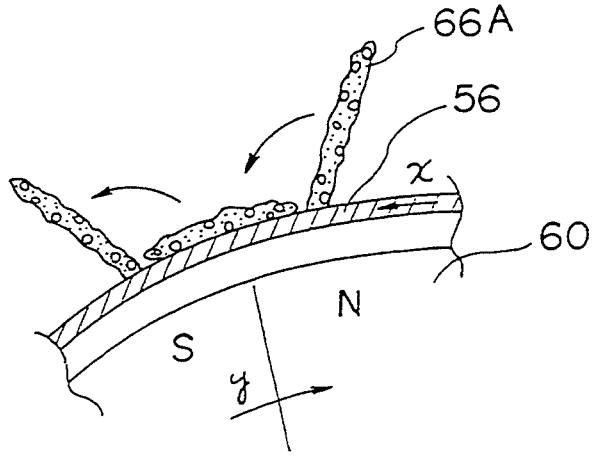
Fig.8 RELATED ART
FIG. 8 is a schematic, fragmentary sectional view showing the movement of a developer on the circumference of a developing sleeve.
Figure 9:
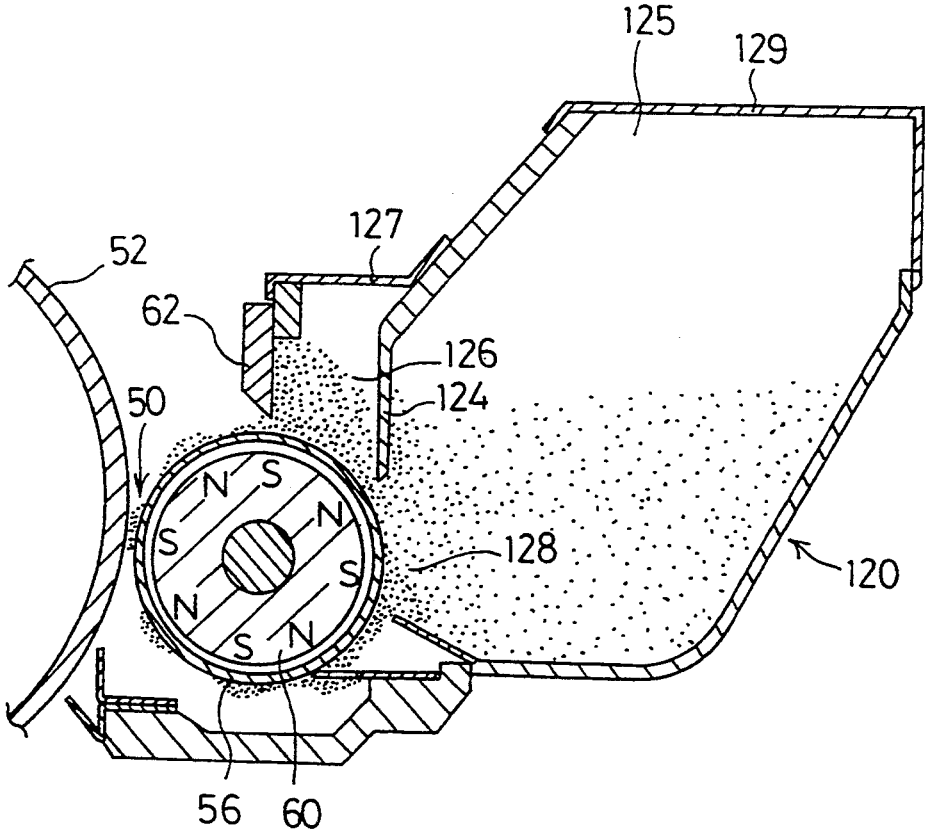
Fig.9 RELATED ART
FIG. 9 is a sectional view of another prior art process cartridge.

Upon the exhaustion of the magnetic toner 20 contained in the toner container 64, the upper unit 1A is removed from the developing device 1, a toner supply unit 20A containing magnetic toner 20 and sealed with a film 67 is joined to the lower unit 1C of the developing device 1 as shown in FIG. 6.

Then, the film 67 is removed through a slit in the cartridge wall or from between the upper and lower units to let the magnetic toner 20 fall into the lower unit 1C and flow through the supplying path 64B toward the developing sleeve 56.

A developing device 1 in a second embodiment according to the present invention included in a process cartridge C will be described hereinafter with reference to FIGS. 4 and 5, in which parts like or corresponding to those of the developing device 1 in the first embodiment are denoted by the same reference characters and the description thereof will be omitted. The developing device 1 in the second embodiment is the same in construction as the developing device 1 in the first embodiment, except that the developing device 1 in the second embodiment is provided with a fixed partition wall 2 not having any swing section.

Figure 4:
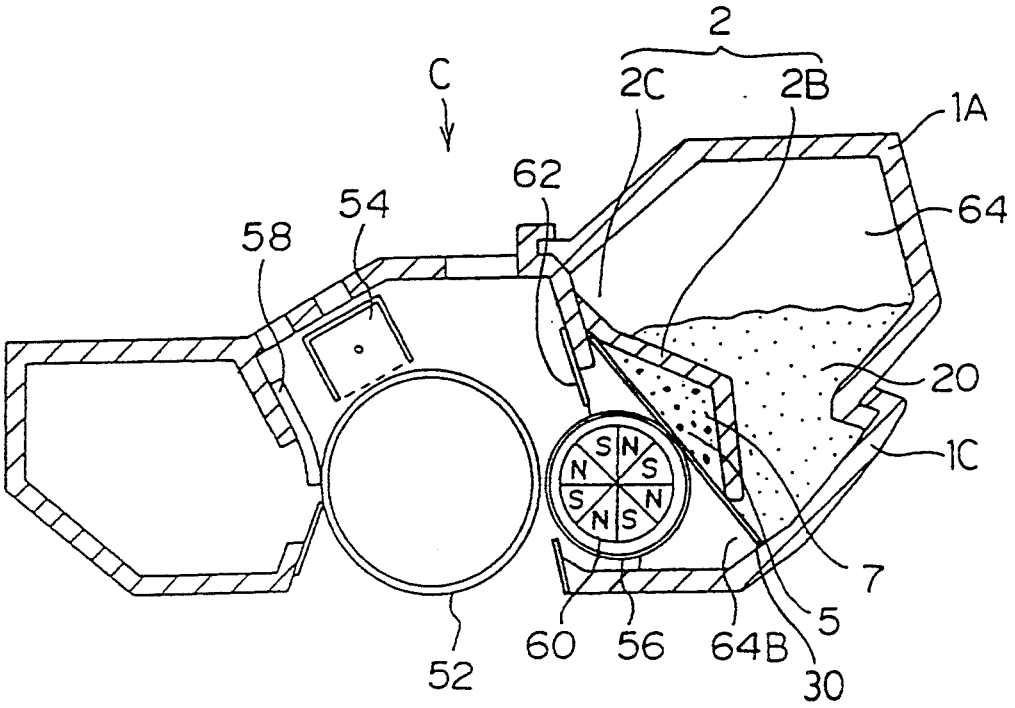
FIG. 4 is a schematic sectional view of an unused process cartridge including a developing device in a second embodiment according to the present invention.

Referring to FIG. 4, the partition wall 2 is extended near a developing sleeve 56 so that a supplying path 64B is formed between the free edge 2B of the partition wall 2 and the lower wall of the toner container 64, and a film 30 is extended between the root 2C of the partition wall 2 and the lower wall of the toner container 64 via the free edge so as to close the supplying path 64B. An initial developer 5 is sealed with the film 30 in an initial developer storage space formed by the partition wall 2, and the magnetic toner 20 is sealed with the partition wall 2 and the film 30 in a toner container 64.

Figure 5:
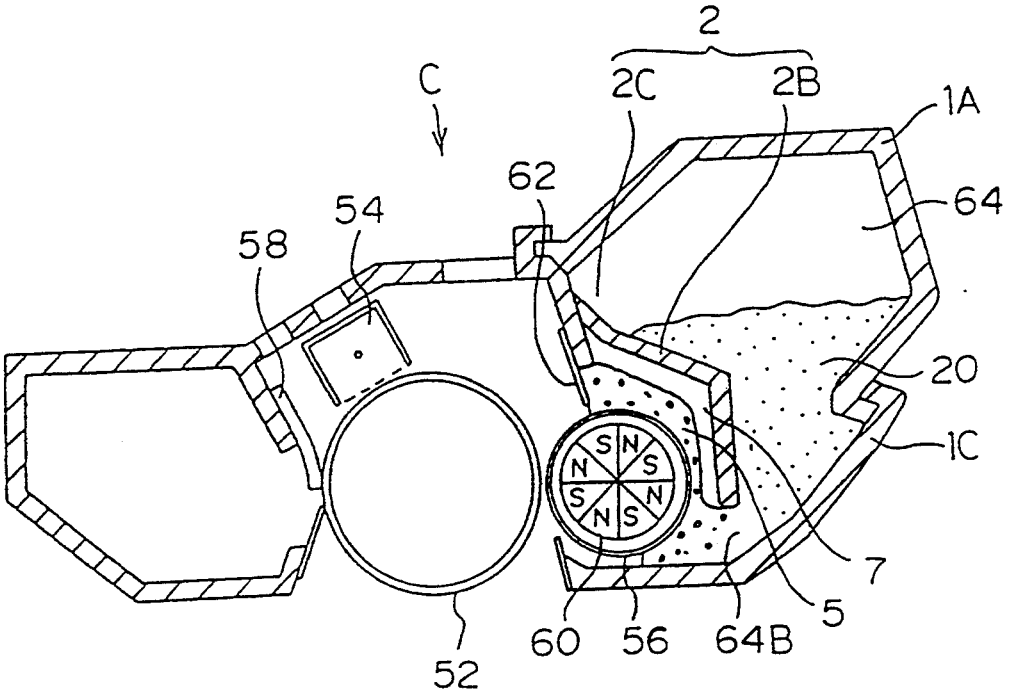
FIG. 5 is a schematic sectional view of the process cartridge of FIG. 4 in a state where a sealing film has been removed.

When using the process cartridge C, the film 30 is removed to let the initial developer 5 fall over the developing sleeve 56 and to let the magnetic toner 20 flow through the supplying path 64B toward the developing sleeve 56 as shown in FIG. 5.

Since the initial developer 5 is sealed in the initial developer storage space 7 and the magnetic toner 20 is sealed in the toner container 64 before using the process cartridge C, the initial developer 5 and the magnetic toner 20 will never spill out during transportation. Both the initial developer 5 and the magnetic toner 20 can be surely supplied to the developing sleeve 56 simply by removing the film 3 from the process cartridge C. Since the magnetic carrier is unable to disperse in the magnetic toner 20 contained in the toner container 64, the magnetic carrier percentage of the developer adhering to the circumference of the developing sleeve 56 can be maintained at a high value.

Upon the exhaustion of the magnetic toner 20 contained in the toner container 64, the upper unit 1A is removed from the developing device 1 and a toner supply unit 20A, which is the same as that used in the first embodiment, is mounted on the developing device 1 to supply the magnetic toner 20.

Although the invention has been described in its preferred forms with a certain degree of particularity, obviously many changes and variations are possible therein. It is therefore to be understood that the present invention may be practiced otherwise than as specifically described herein without departing from the scope and spirit thereof as defined in the appended claims.

What is claimed is:

1. A process cartridge for use in an electro-static developing device including a developer sleeve surrounding a conductive roller, and containing developer therein including magnetic toner and magnetic carrier, the process cartridge comprising:

a lower unit having side walls and an access opening for receiving the developer sleeve;

an upper unit detachably coupled to and in communication with said lower unit; and a partition assembly extending within and across said cartridge, including a partition wall coupled to one of said lower unit and said upper unit, wherein a toner supply path is defined between said partition wall and one of said side walls of said lower unit during operation, and including a removable seal extending adjacent said partition wall across said toner supply path to said one side wall of said lower unit and removably sealing said toner supply path, wherein said partition wall and said upper unit define a toner holding space and said partition wall and said removable seal define an initial developer holding space.

2. The process cartridge of claim 1, wherein said partition wall is coupled to said lower unit.

3. The process cartridge of claim 1, wherein said seal is secured to said partition wall adjacent said lower unit.

4. The process cartridge of claim 1, wherein said upper unit includes an additional removable seal, said additional seal and said upper unit defining a replacement toner holding space.

5. The process cartridge of claim 1, wherein said partition wall is upwardly convex.

6. The process cartridge of claim 1, wherein said partition wall is immovably fixed.

7. The process cartridge of claim 1, wherein said partition wall includes a swing portion pivotally coupled to swing into said lower unit.

8. The process cartridge of claim 7, further comprising a stop member extending from one of said side walls of said lower unit to limit pivotal movement of said swing portion.

9. The process cartridge of claim 7, wherein said seal extends beneath said partition wall to hold said partition wall from swinging downwardly.

10. The process cartridge of claim 1, wherein said upper unit includes a projection extending adjacent said lower unit and said seal extends across said cartridge to said projection.

11. The process cartridge of claim 1, wherein said seal extends across said cartridge to one of said side walls of said lower unit.

12. A developing device of an electrostatic apparatus comprising:

a lower unit an upper unit pre-operationally storing magnetic developer, said lower unit in communication with said upper unit in an operational condition;

rotatable developer carrying means for carrying the magnetic developer located adjacent said lower unit;

rotatable magnetic means provided within said rotatable developer carrying means for charging the magnetic developer;

blade means for restraining a thickness of the magnetic developer carried on said developer carrying means, and being located adjacent said rotatable developer carrying means;

separating means for separating said lower unit and upper unit and defining a supply path for the magnetic developer from said upper unit through said lower unit; and sealing means for removably sealing at least said upper unit, wherein said sealing means extends under said upper unit and defines a separate initial developer space with said separating means independent from said upper unit, and wherein said sealing means releases to supply the magnetic developer and an initial developer to said developer carrying means.

13. The developing device of claim 12, wherein said separating means is located in said lower unit.

14. The developing device of claim 12, wherein said separating means is immovably fixed.

15. The developing device of claim 12, wherein at least a portion of said separating means is pivotal and is coupled to swing into said lower unit toward said rotatable developer carrying means when said sealing means is removed.

16. The developing device of claim 15, further comprising a stop means for limiting pivotal movement of said swing portion located in said lower unit.

17. The developing device of claim 12, wherein said sealing means is a film secured to said separating means.

18. The developing device of claim 12, wherein said upper unit includes a projection extending adjacent said lower unit and said sealing means extends across said supply path to said projection.

19. The developing device of claim 12, wherein said upper unit is detachable from said lower unit.

20. The developing device of claim 12, wherein said upper unit includes an additional removable sealing means for sealing a replacement toner holding space in said upper unit.

21. The developing device of claim 12, wherein said sealing means is a film.

22. The developing device of claim 12, wherein said lower unit stores magnetic carrier.

23. The developing device of claim 12, wherein said upper unit stores magnetic toner.

24. The developing device of claim 12, wherein said separating means is an upwardly-convex partition wall.

* * * * *